US010471329B2

(12) United States Patent
Johnson

(10) Patent No.: US 10,471,329 B2
(45) Date of Patent: Nov. 12, 2019

(54) GOLF PUTTING TRAINING DEVICES AND METHODS OF USE THEREOF

(71) Applicant: Alan Johnson, Southfield, MI (US)

(72) Inventor: Alan Johnson, Southfield, MI (US)

( * ) Notice: Subject to any disclaimer, the term of this patent is extended or adjusted under 35 U.S.C. 154(b) by 0 days.

(21) Appl. No.: 16/119,174

(22) Filed: Aug. 31, 2018

(65) Prior Publication Data

US 2019/0099651 A1 Apr. 4, 2019

Related U.S. Application Data

(63) Continuation-in-part of application No. 15/678,080, filed on Aug. 15, 2017, now abandoned.

(51) Int. Cl.

*A63B 69/36* (2006.01)
*A63B 63/00* (2006.01)
*A63B 69/00* (2006.01)

(52) U.S. Cl.

CPC ..... *A63B 69/3676* (2013.01); *A63B 63/003* (2013.01); *A63B 69/0073* (2013.01); *A63B 2063/002* (2013.01)

(58) Field of Classification Search

CPC ..... A63B 69/3676; A63B 69/0073; A63B 63/003; A63B 2063/002
USPC ..... 473/157, 172, 179, 185, 187, 188, 189
See application file for complete search history.

(56) References Cited

U.S. PATENT DOCUMENTS 1,208,838 A * 12/1916 Rolfe ..... A63B 69/3676 473/187
1,400,066 A 12/1921 Huck
1,427,537 A * 8/1922 McLean ..... A63B 69/3676 473/187
2,712,199 A 7/1955 Latimer
3,338,579 A * 8/1967 McKain ..... A63B 69/3676 273/127 R
3,507,499 A * 4/1970 Rice ..... A63B 69/3676 473/188
4,100,952 A 7/1978 Neudorfer
4,242,969 A 1/1981 Checkwood et al.
4,359,225 A * 11/1982 Baldorossi ..... A63B 69/3655 473/187
4,563,010 A 1/1986 McDorman et al.
4,906,006 A * 3/1990 Sigunick ..... A63B 57/357 473/185
5,014,994 A 5/1991 Peters
5,707,300 A 1/1998 May et al.
7,115,044 B2 * 10/2006 Faltin ..... A63B 69/0075 473/266
D609,503 S 2/2010 Hayes
(Continued)

*Primary Examiner* — Nini F Legesse
(74) *Attorney, Agent, or Firm* — Burris Law, PLLC

(57) ABSTRACT

A golf putting training device with a base and a plurality of posts extending upwardly from the base is provided. The plurality of posts may be positioned on a diameter of a circle and the diameter may be generally equal to a golf hole diameter. A distance between at least two of the plurality of posts is less than the golf hole diameter and thereby provides a narrow opening for a golf ball to roll through. A pair of sleeves may be positioned on a pair of adjacent posts such that the narrow opening for the golf ball to roll through is reduced. Also, an elastic member may extend between two posts and across the narrow opening for the golf ball to roll through such that a golf ball putted towards the narrow opening is redirected when it is rolls into the elastic member.

20 Claims, 13 Drawing Sheets

(56) References Cited

U.S. PATENT DOCUMENTS

| | | | |
|---|---|---|---|
| 8,696,484 | B2 | 4/2014 | Shahi et al. |
| 2005/0032580 | A1 | 2/2005 | Rango |
| 2016/0273701 | A1 | 9/2016 | Heyring et al. |

* cited by examiner

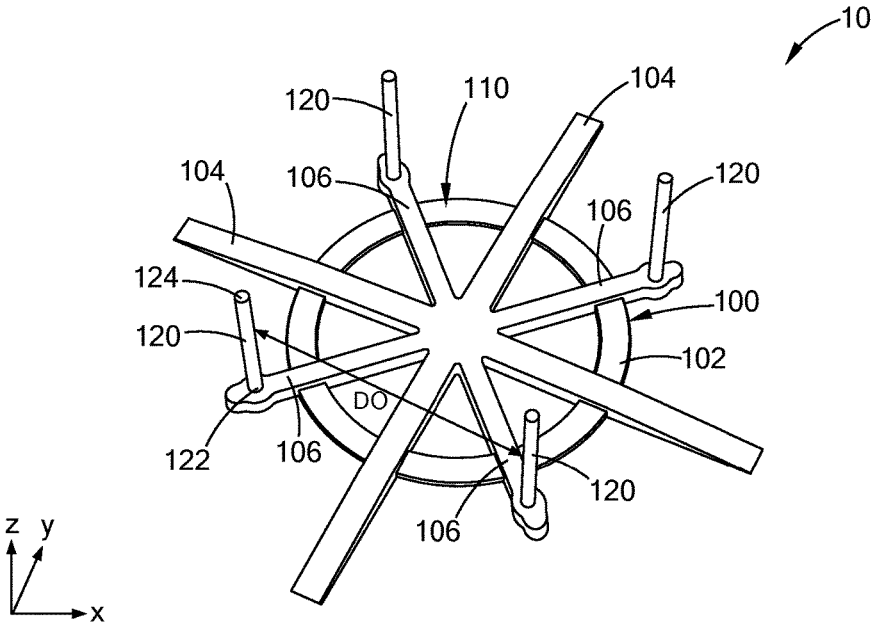
FIG. 1
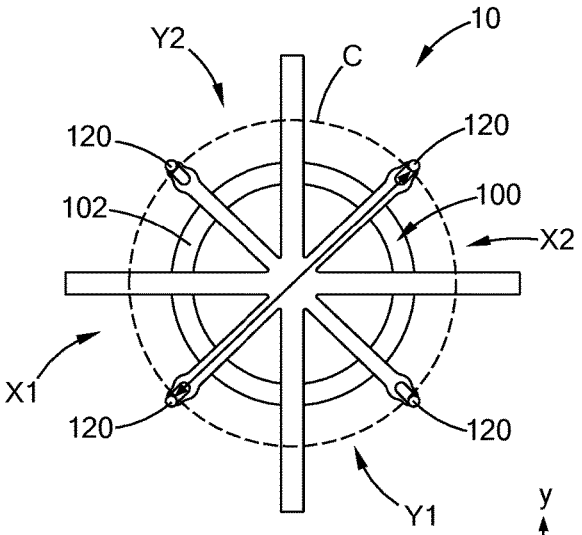
FIG. 2A
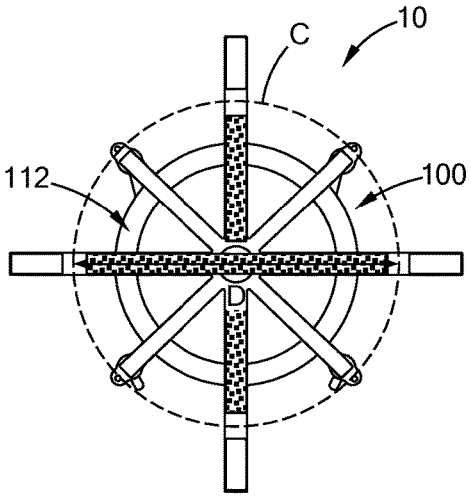
FIG. 2B
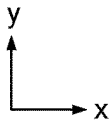

GOLF PUTTING TRAINING DEVICES AND METHODS OF USE THEREOF

CROSS-REFERENCE TO RELATED APPLICATIONS

This application is a continuation-in-part of U.S. application Ser. No. 15/678,080 filed on Aug. 15, 2017. The disclosure of the above application is incorporated herein by reference.

FIELD

The present disclosure relates to golf training devices, and particularly, to golf putting training devices that provide a narrow opening/target for a golfer to practice putting.

BACKGROUND

The statements in this section merely provide background information related to the present disclosure and may not constitute prior art.

Golf putting training devices that use rails, laser sighting techniques and the like are known. However, such golf putting training devices may be heavy, bulky, complicated and/or cost prohibitive. Accordingly, an improved golf putting device that is light weight, portable, and easy to use is desired.

SUMMARY

In one form of the present disclosure, a golf putting training device includes a base and a plurality of posts extending upwardly from the base. The plurality of posts may be positioned on a diameter of a circle. In some aspects of the present disclosure, the plurality of posts are four posts and the four posts are positioned equidistant from each other on the diameter of the circle. Also, the diameter of the circle may be generally equal to a golf hole diameter. A distance between at least two of the plurality of posts is less than the golf hole diameter and thereby provides a narrow opening for a golf ball to roll through. That is, a narrow opening for a golf ball to roll through is provided between at least two of the plurality of posts. In some aspects of the present disclosure, the diameter of the circle may be between about 3.0 inches and about 5.0 inches. In one aspect of the present disclosure, the diameter of the circle is about 4.0 inches. Accordingly, a distance between two of the plurality of posts may be between about 3.75 inches and about 1.75 inches, for example, about 2.75 inches. An alignment guide may extend between two of the plurality of posts. Also, one or more securement posts may extend downwardly from the base. In some aspects of the present disclosure, a plurality of securement posts may extend downwardly from the base and such that the plurality of securement posts may be positioned within a golf hole. The base may have a generally flat bottom surface and an attachment surface may be attached to the generally flat bottom surface. In some aspects of the present disclosure, the attachment surface may be a hook and loop fastener, an adhesive, and/or a tacky surface. In some aspects of the present disclosure, an elastic member may be attached to two of the plurality of posts and extend across the narrow opening therebetween. The elastic member may be configured to redirect a golf ball rubber that rolls into the elastic member. In other aspects of the present disclosure, a pair of sleeves may be positioned on a pair of adjacent posts such that the pair of sleeves reduce the narrow opening for the golf ball to roll through. That is, the pair of sleeves make the narrow opening through which the golf ball can roll through narrower.

In another form of the present disclosure, a golf putting training device includes a base and a pair of posts positioned on and extending upwardly from a base. The pair of posts have a narrow opening therebetween for a golf ball to roll through and the narrow opening between the pair of posts is less than a golf hole diameter. In some aspects of the present disclosure, the golf putting training device further includes another pair of posts, four total, and the four posts are positioned on the diameter of the base 90 degrees relative to each other. The diameter may be between about 3.0 inches and about 5.0 inches and a distance between two of the plurality of posts may be between about 3.75 inches and about 1.75 inches. In at least one aspect of the present disclosure, a pair of sleeves may be positioned on a pair of adjacent posts and the pair of sleeves reduce the narrow opening for a golf ball to roll through and thereby narrow a target for a golfer practicing putting with the golf putting training device.

In still another form of the present disclosure, a method of practicing putting a golf ball includes positioning a golf putting training device on a putting surface. The golf putting training device includes a base and a pair of posts positioned on and extending upwardly from a diameter on the base. The pair of posts have a narrow opening therebetween for a golf ball to roll through and the narrow opening between the pair of posts is less than a golf hole diameter and thereby provides a narrow target for putting practice. A golf ball is positioned on the putting surface at a distance from the narrow opening between the pair of posts and a golfer putts the golf ball towards the narrow opening. In some aspects of the present disclosure, the method includes extending an elastic member across the narrow opening between the pair of posts and putting the golf ball towards the narrow opening such that the elastic member redirects the golf ball when the golf ball rolls into the elastic member. In other aspects of the present disclosure, the method includes positioning a pair of sleeves onto the pair of posts such that the narrow opening for a golf ball to roll through is made narrower by the pair of sleeves.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 1 is a perspective view of a golf putting training device according to the teachings of the present disclosure;

FIG. 2A is a top view of the golf putting training device in FIG. 1;

FIG. 2B is a bottom view of the golf putting training device in FIG. 1;

Figure 13:
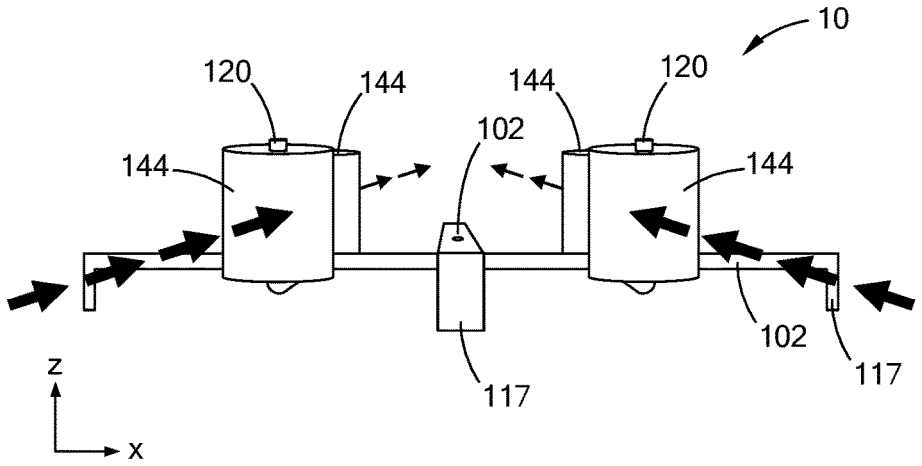
Figure 14:
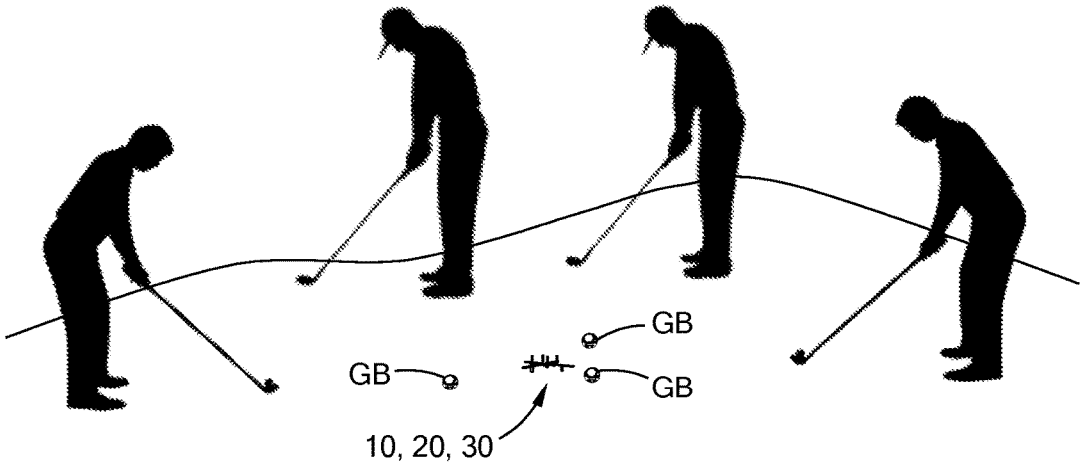

FIG. 13 a side view of the golf putting training device with alignment arrows depicting a golfer viewing the golf putting training device while properly aligned with respect to a narrow opening between a pair of posts according to the teachings of the present disclosure; and FIG. 14 is a perspective view of four golfers practicing putting using a golf putting device according to the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIGS. 1, 2A and 2B, a perspective view, top view and bottom view, respectively, of a golf putting training device 10 (also referred to herein simply as a "putting device") according to the teachings of the present disclosure are shown. The putting device 10 may include a base 100 with a top surface 110 (+z direction), a bottom surface 112 (−z direction), and a plurality of posts 120 extending upwardly (+z direction) from the base 100 between a lower end 122 (−z direction) and an upper end 124 (+z direction). The plurality of posts 120 may extend upwardly from the top surface 110 of the base 100. In the alternative, or in addition to, at least one of the posts 120 may extend upwardly from a side surface (not labeled) extending from the top surface 110 to the bottom surface 112 of the base 100. The plurality of posts 120 are spaced apart from each other and may be positioned on a diameter 'D' of a circle 'C'. In some aspects of the present disclosure, the plurality of posts 120 are spaced equidistant from each other such that four posts 120 are oriented 90 degrees from each other on the diameter D of the circle C as schematically depicted in FIG. 2A. In such aspects, the plurality of posts 120 provide a narrow opening 'DO' between adjacent posts 120 that is less than the diameter D of the circle C. As used herein, the phrase "narrow opening" refers a distance between two objects that is less than a diameter of a golf hole (also referred to herein as a "golf hole diameter"). In one aspect, the diameter D may be generally equal to a diameter of a golf hole, i.e., 4.25 inches (107.95 millimeters). Accordingly, a narrow opening DO that is less than the diameter of a golf hole and through which a golf ball may be rolled through is provided between a pair of adjacent posts 120. For example, and with reference to FIG. 2A, in aspects of the present disclosure where four posts 120 are spaced equidistant from each other and extend upwardly from the base 100, four narrow openings Y1, Y2, X1, X2 with a distance DO between adjacent posts 120 are provided between the four posts 120. Also, the narrow opening X2 is oriented 90° from the narrow opening Y1, the narrow opening Y2 is oriented 90° from the narrow opening X2, the narrow opening X1 is oriented 90° from the narrow opening Y2, and the narrow opening Y1 is oriented 90° from the narrow opening X1. Such narrow openings oriented at an angle (e.g., 90°) from each other allow for multiple individuals (also referred to herein as "golfers") to practice putting with the putting device 10 at one time. That is, one golfer may practice putting a golf ball through the narrow opening Y1 and another golfer may practice putting a golf ball through the narrow opening X2, etc.

The base 100 may include a ring 102 and an alignment guide 104. As schematically depicted in FIGS. 1, 2A and 2B, a pair of alignment guides 104 oriented generally 90 degrees relative to each other may be included. In some aspects of the present disclosure, the plurality of posts 120 may extend upwardly from the ring 102 (not shown). In other aspects of the present disclosure, the plurality of posts may extend upwardly from support members 106 that extend beyond the ring 102. That is, each of the posts 120 extends upwardly from a support member 106 that extends outwardly from the ring 102. As used herein the term "outwardly" refers to a direction extending away from a center (not labeled) of the circle C. While FIGS. 1, 2A and 2B schematically depict vacant space between an interior (not labeled) of the ring 102 and the alignment members 104 and support members 106, it should be understood that the base 100 may have other shapes. For example, the base 100 may be a solid planar member from which the plurality of posts 120 extending upwardly from, a plurality of rings from which one of the rings the plurality of posts 120 extend upwardly from, a plurality of support members 106 without a ring, a single ring from which the plurality of posts 120 extending upwardly from, and the like.

Figure 3A:
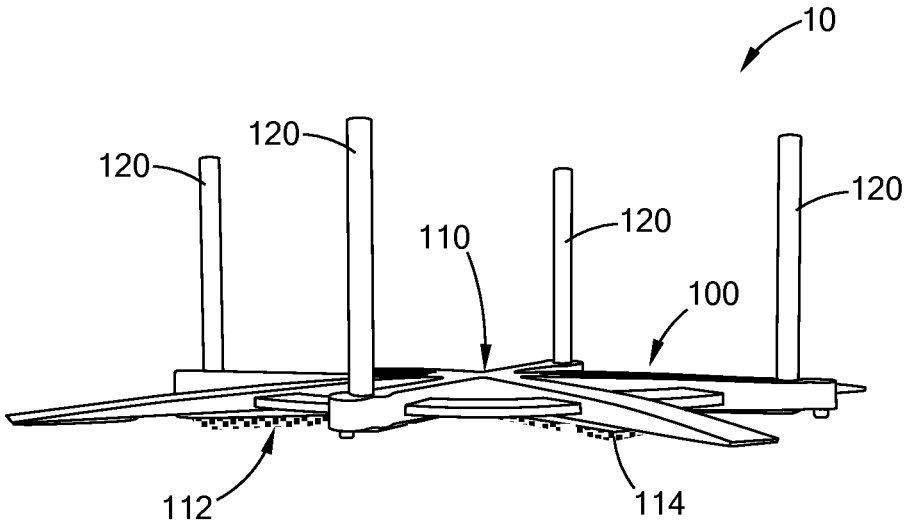
FIG. 3A is a side view of a golf putting training device according to the teachings of the present disclosure.

Referring now to FIG. 3A, in some aspects of the present disclosure a bottom surface 112 of the base 100 may be generally flat or planar such that the putting device may be placed and used on a floor, a floor with carpet, a surface with artificial turf, and the like. In such aspects, the bottom surface 112 may include an attachment surface 114 that attaches or releasably attaches the bottom surface 112 of the putting device 10 to a surface. As used herein, the term "attaches" refers to attachment of the putting devices disclosed herein to a surface such that a tool is required to remove the putting devices from the surface and the phrase "releasably attached" refers to attachment of the putting devices disclosed herein to a surface such that a tool is not required to remove the putting devices from the surface. For example, if the putting device 10 is attached to a surface a tool, e.g., a screw driver or a paint scrapper, is needed to remove or detach the putting device 10 from the surface. In the alternative, if the putting device 10 is releasably attached to a surface, then the putting device 10 may be removed or detached from the surface by a golfer simply grabbing the putting device 10 and pulling it off of the putting surface. Non-limiting examples of an attachment surface 114 include a hook-and-loop fastener that may be used to releasably attach the bottom surface 112 to a carpet surface (not shown), an adhesive that may be used to permanently or releasably attach the bottom surface 112 to a smooth floor surface and/or a carpet surface, a tacky surface that may be used to releasably attach the bottom surface 112 to a smooth floor surface and/or a carpet surface, and the like. Attachment and releasable attachment of the putting device 10 to a surface via the attachment surface 114 allows for a golfer to practice putting with the putting device 10 such that a golf ball may roll into one or more of the posts 120 without the putting device 10 moving from a position where it is attached to the surface.

Figure 3B:
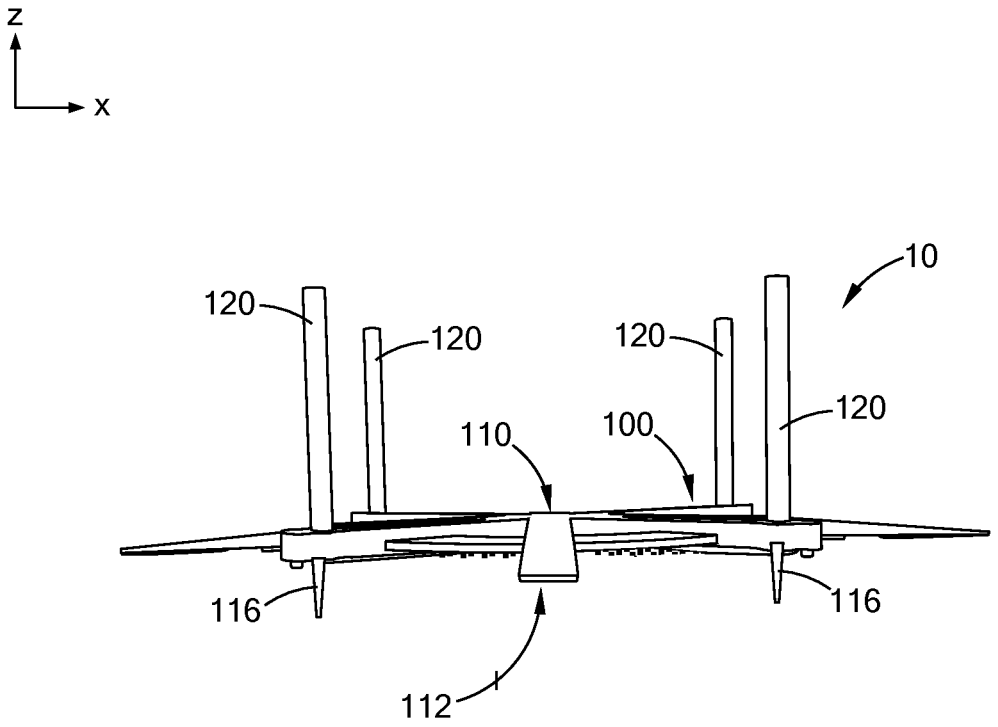
FIG. 3B is a side view of a golf putting training device according to the teachings of the present disclosure.

Referring now to FIG. 3B, in other aspects of the present disclosure one or more bottom tabs 116 may extend downwardly (−z direction) from the bottom surface 112 of the putting device 10. In such aspects, a plurality of tabs 116 may extend from the bottom surface 112 and penetrate into a grass surface (e.g., a putting green surface) such that the putting device is releasably attached to the grass surface. In the alternative, or in addition to, a plurality tabs 116 may extend from the bottom surface 112 and be positioned such that the tabs 116 fit within and align the putting device over a golf hole, e.g., a golf hole on a putting green. Similar to the bottom surface 112 with the attachment surface 114, the plurality of tabs 116 extending downwardly from the bottom surface 112 allow for a golfer to practice putting with the putting device 10 such that a golf ball may roll into one or more of the posts 120 without the putting device 10 moving from a position where it is attached to the grass surface.

Figure 4:
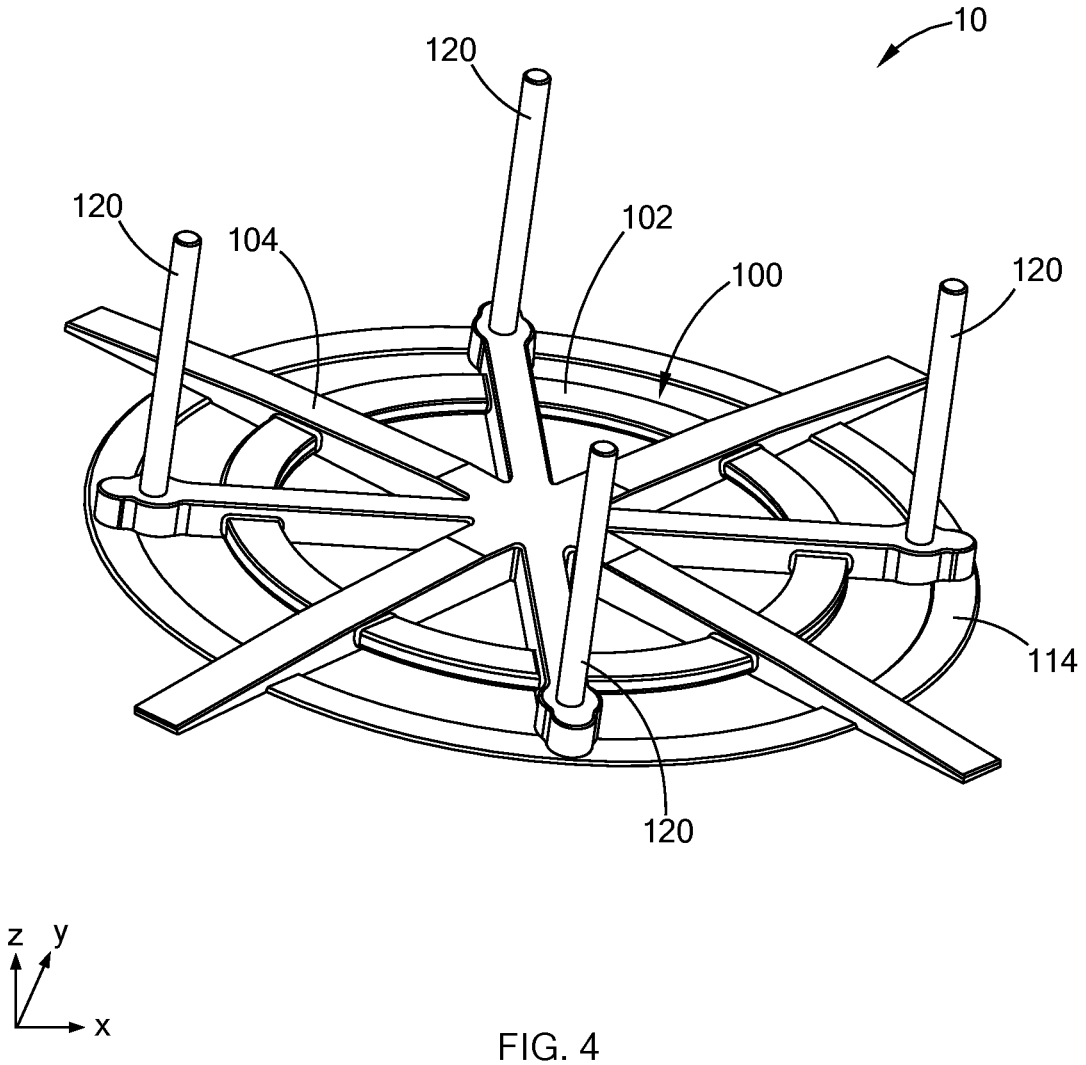
FIG. 4 is a perspective view of a golf putting training device according to the teachings of the present disclosure.

While FIG. 3A schematically depicts the attachment surface 114 extending from the base 100, it should be understood that other arrangements of the attachment surface 114 are within the scope of the present disclosure. For example, FIG. 4 schematically depicts an attachment surface 114 in the form of an external ring positioned outwardly from the ring 102.

Figure 5A:
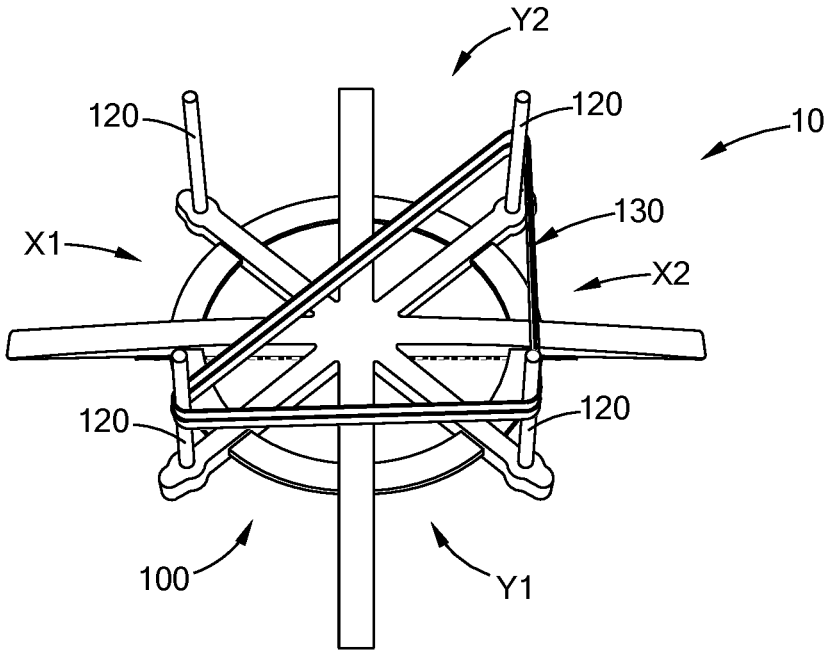
FIG. 5A is a perspective view a golf putting training device with an elastic member according to the teachings of the present disclosure.
Figure 5B:
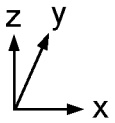
FIG. 5B is a perspective view a golf putting training device with an elastic member according to the teachings of the present disclosure.
Figure 5B:
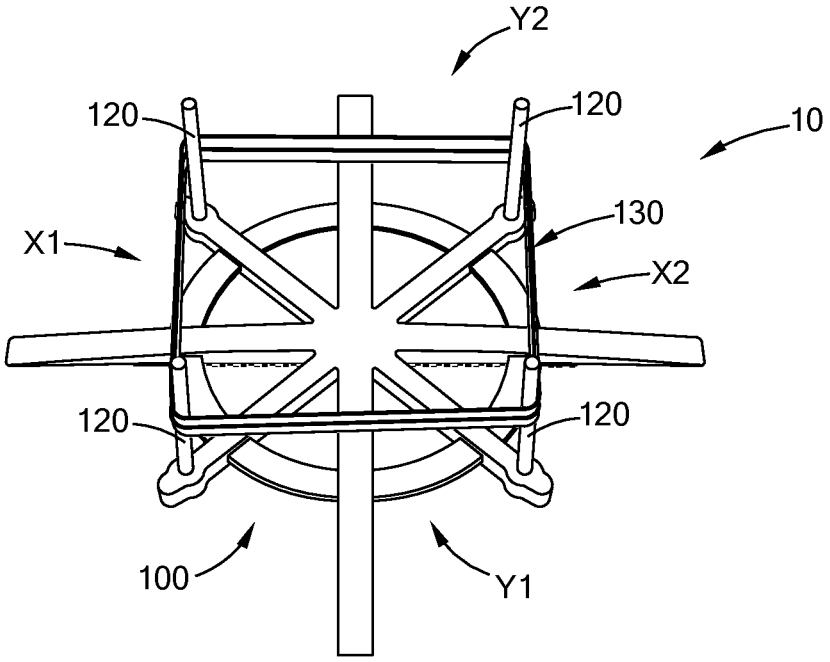

Referring now to FIGS. 5A and 5B, in one form of the present disclosure the putting device 10 may include an elastic member 130 that extends between at least two posts 120 and thereby provides a golf ball delivery or return mechanism. Particularly, the elastic member 130 redirects a golf ball that is putted towards the putting device 10 and strikes or rolls into the elastic member 130. As schematically depicted in FIG. 5A, the elastic member 130 may extend between three of the posts 120 such that a golf ball putted towards the narrow opening Y1 and/or X2 may be returned to a golfer that has putted the golf ball. Also, a golf ball putted towards the narrow opening Y2 may be redirected to the narrow opening X1, or vice versa. As schematically depicted in FIG. 5B, the elastic member 130 may extend between all of the posts 120 of the putting device 10 such that a golf ball putted towards the narrow opening Y1, Y2, X1 and/or X2 may be returned a golfer or to golfers that have putted the golf ball(s) towards the narrow opening Y1, Y2, X1 and/or X2, respectively. Non-limiting examples of elastic members 130 include rubber bands, hair bands, O-rings, and the like. While FIGS. 5A and 5B schematically depict two arrangements or configurations of the elastic member 130 extending between at least two posts 120, it should be understood that the elastic member 130 may extend between posts 120 in different configurations than shown in the figures. For example, the elastic member may extend only between a pair of posts 120.

Figure 6A:
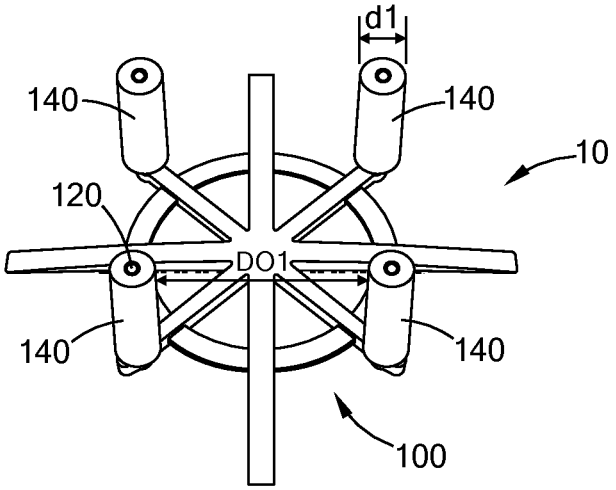
FIG. 6A is a perspective view a golf putting training device with a plurality of sleeves according to the teachings of the present disclosure.
Figure 6B:
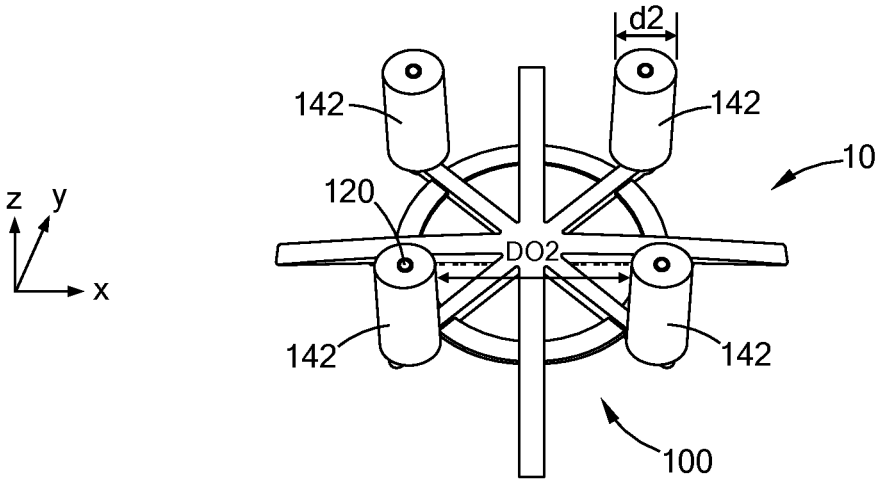
FIG. 6B is a perspective view a golf putting training device with a plurality of sleeves according to the teachings of the present disclosure.
Figure 6C:
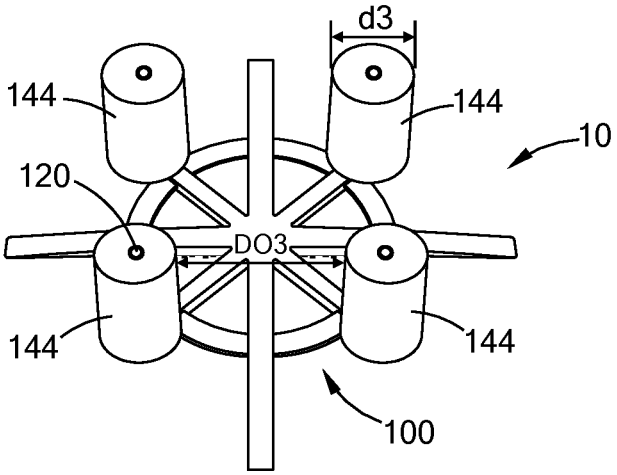
FIG. 6C is a perspective view a golf putting training device with a plurality of sleeves according to the teachings of the present disclosure.

Referring now to FIGS. 6A-6C, in another form of the present disclosure the putting device may include one or more post sleeves (also referred to herein simply as "sleeves") that reduce or narrow the narrow opening for a golf ball to roll between (i.e., narrow the opening Y1, Y2, X1 and/or X2). For example, and with reference to FIG. 6A, a plurality of sleeves 140 having a first outer diameter 'd1' may be positioned on the plurality of posts 120 as schematically depicted. In some aspects of the present disclosure, the post sleeves 140 may have an inner opening or hole (not labeled) with a diameter that allows for the post sleeves 140 to slide over the posts 120. As shown in FIG. 6A, adjacent sleeves 140 with first outer diameter d1 have a distance 'DO1' therebetween. The distance DO1 is less than the distance DO (FIG. 1) such that the narrow opening Y1 (and the narrow openings Y2, X1, X2) is narrower when the post sleeves 140 are positioned over the posts 120. Accordingly, a golfer practicing putting with the sleeves 140 positioned on the posts 120 has a narrower opening or target to putt a ball through compared to when the sleeves 140 are not positioned on the posts 120.

Referring now to FIG. 6B, a plurality of sleeves 142 having a second outer diameter 'd2' greater than the first outer diameter d1 of the sleeves 140 may be positioned on the plurality of posts 120 as schematically depicted. In some aspects of the present disclosure, the sleeves 142 may have an inner opening or hole (not labeled) with a diameter that allows for the sleeves 142 to slide over the posts 120. As shown in FIG. 6B, adjacent sleeves 142 with the second outer diameter d2 have a distance DO2' therebetween. The distance DO2 is less than the distance DO1 (FIG. 5A) such that the narrow opening Y1 (and the narrow openings Y2, X1, X2) is narrower when the post sleeves 142 are positioned over the posts 120. Accordingly, a golfer practicing putting with the sleeves 142 positioned on the posts 120 has a narrower opening or target to putt a ball through compared to when the sleeves 140 are positioned on the posts 120 and when the sleeves 140 are not positioned on the posts 120.

Referring now to FIG. 6C, a plurality of sleeves 144 having a third outer diameter 'd3' greater than the second outer diameter d2 of the sleeves 142 may be positioned on the plurality of posts 120 as schematically depicted. In some aspects of the present disclosure, the sleeves 144 may have an inner opening or hole (not shown) with a diameter that allows for the sleeves 144 to slide over the posts 120. As shown in FIG. 6C, adjacent posts sleeves 144 with the third outer diameter d3 have a distance 'DO3' therebetween. The distance DO3 is less than the distance DO2 (FIG. 5B) such that the narrow opening Y1 (and the narrow openings Y2, X1, X2) is narrower when the sleeves 144 are positioned over the posts 120. Accordingly, a golfer practicing putting with the sleeves 144 positioned on the posts 120 has a narrower opening or target to putt a ball through compared to when the sleeves 142 are positioned on the posts 120, when the sleeves 140 are positioned on the posts 120, and when the sleeves 140 or 142 are not positioned on the posts 120.

Figure 7A:
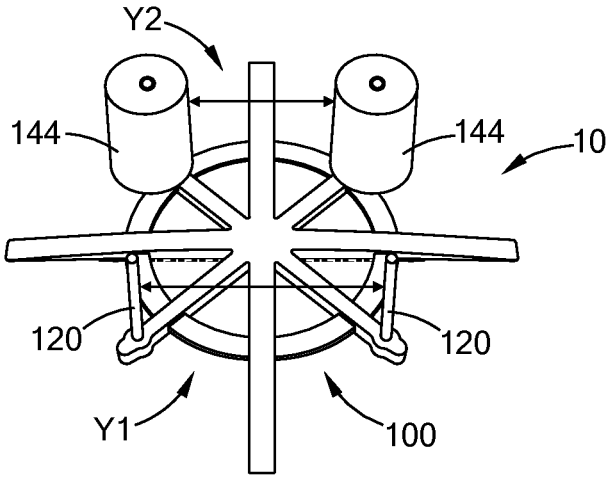
FIG. 7A is a perspective view a golf putting training device with a plurality of sleeves according to the teachings of the present disclosure.
Figure 7B:
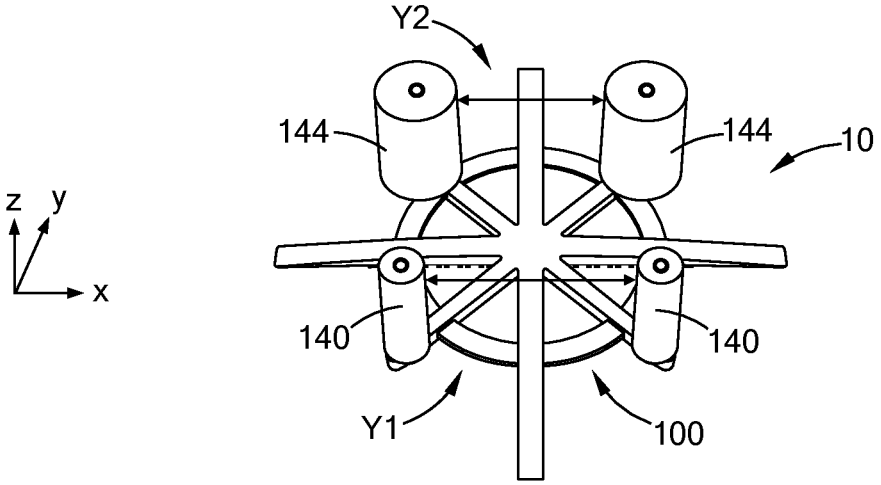
FIG. 7B is a perspective view a golf putting training device with a plurality of sleeves according to the teachings of the present disclosure.
Figure 7C:
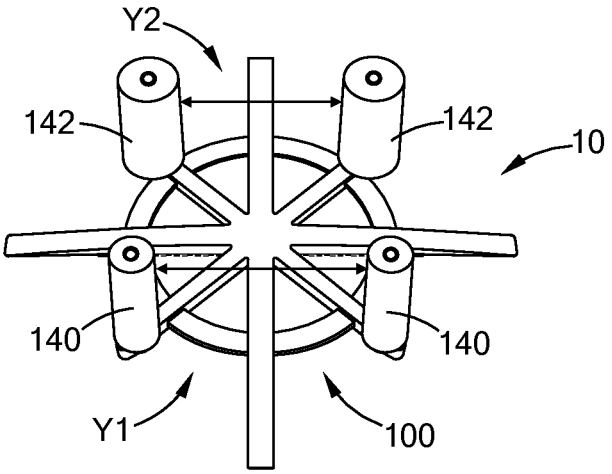
FIG. 7C is a perspective view a golf putting training device with a plurality of sleeves according to the teachings of the present disclosure.

While FIGS. 6A-6C schematically depict the putting device 10 having sleeves with the same diameter positioned on the posts 120, it should be understood that sleeves with different diameters may be positioned on the posts 120. For example, and with reference to FIGS. 7A-7C, the putting device provides for different size openings for a golf ball to roll through. Particularly, FIG. 7A schematically depicts the narrow opening Y1 bounded by posts 120 without sleeves and the narrow opening Y2 bounded by posts 120 with sleeves 144 positioned thereon. FIG. 7B schematically depicts the narrow opening Y1 bounded by posts 120 with sleeves 140 positioned therein and the narrow opening Y2 bounded by posts 120 with sleeves 144 positioned therein. FIG. 7C schematically depicts the narrow opening Y1 bounded by posts 120 with sleeves 140 positioned therein and the narrow opening Y2 bounded by posts 120 with sleeves 142 positioned therein. It should be understood that other configurations with the sleeves 140, 142, and/or 144 positioned on one or more posts 120 are within the scope of the present disclosure.

Figure 8A:
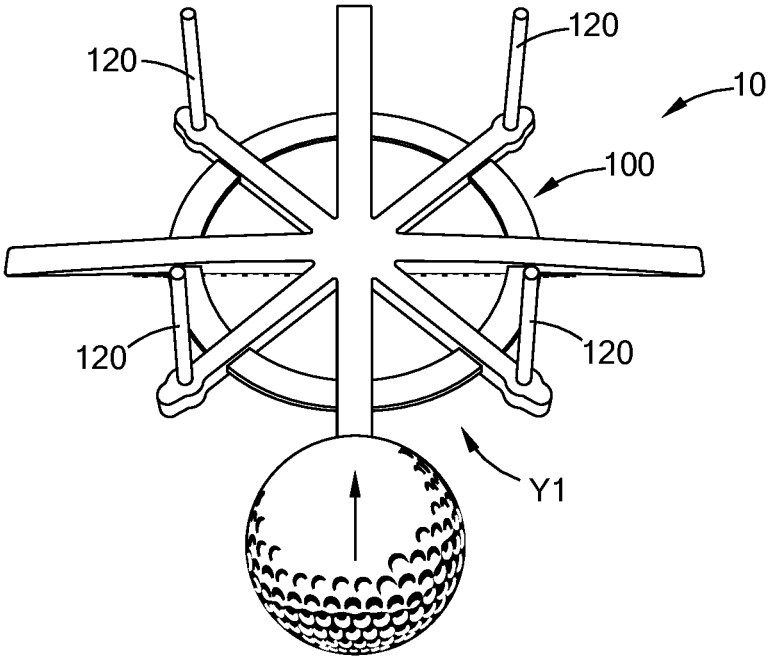
FIG. 8A is a perspective view of a golf putting training device according to the teachings of the present disclosure with a golf ball rolling towards a narrow opening between a pair of posts.
Figure 8B:
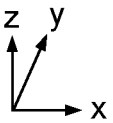
FIG. 8B is a perspective view of the golf putting training device in FIG. 8A with the golf ball having rolled through the narrow opening.
Figure 8B:
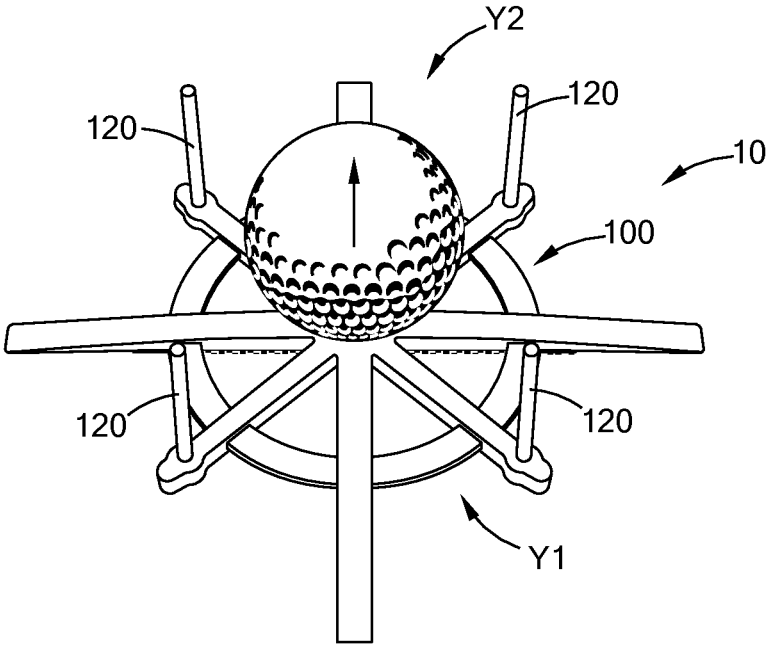
Figure 9:
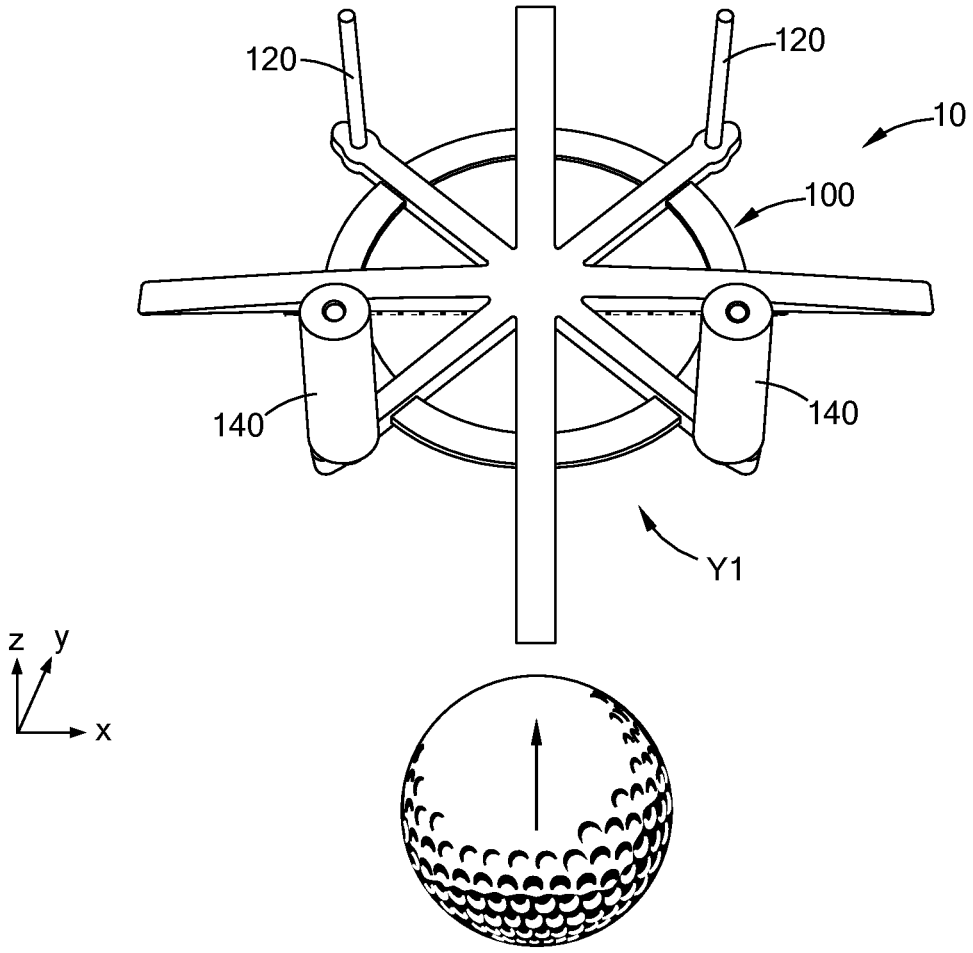
FIG. 9 is a perspective view of the golf putting training device in FIG. 8A with a golf ball rolling towards a narrower opening of the golf putting training device.

Referring now to FIGS. 8A and 8B, in use a golfer positions the putting device 10 on a surface such that the posts 120 extend upwardly from the base 100 and away from the surface. The golfer then attempts to putt a golf ball 'GB' through one of the narrow openings Y1, Y2, X1 or X2. For example, FIG. 8A schematically depicts a golf ball GB rolling towards the narrow opening Y1 and FIG. 8B schematically depicts the GB having rolled between and past the posts 120 bounding the narrow opening Y1. Also, after being successful in putting a golf ball GB between the posts 120 without sleeves positioned thereon, the golfer may attempt to putt the golf ball GB between a narrower opening by positioning the sleeves 140 onto the posts 120 as schematically depicted in FIG. 9.

By attempting to putt the golf ball GB through one of the openings of the putting device 10, the golfer aims at a narrow opening (target) compared to a golf hole. It should be understood that putting at a smaller target than a golf hole may increase or enhance the golfer's focus, aim, alignment, etc. and thereby result in the golfer improving his/her putting on a golf course. For example, after a golfer practices with the putting device 10 and putts a golf ball GB through a narrow opening as discussed above, a golf hole on a golf course may appear relatively large or larger than normal and thereby appear as a larger target to aim at and putt to.

Figure 10A:
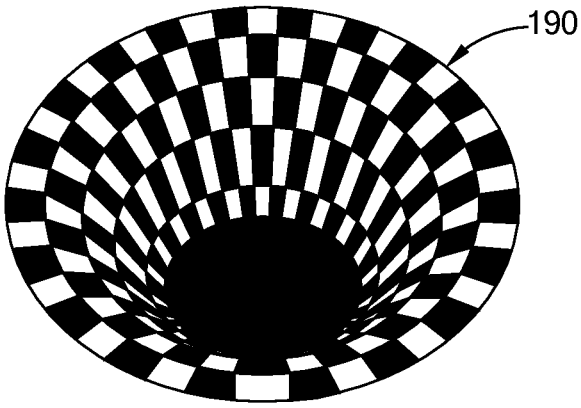
FIG. 10A is a perspective view of a grid pattern having the appearance of a golf hole lying on a putting surface.
Figure 10B:
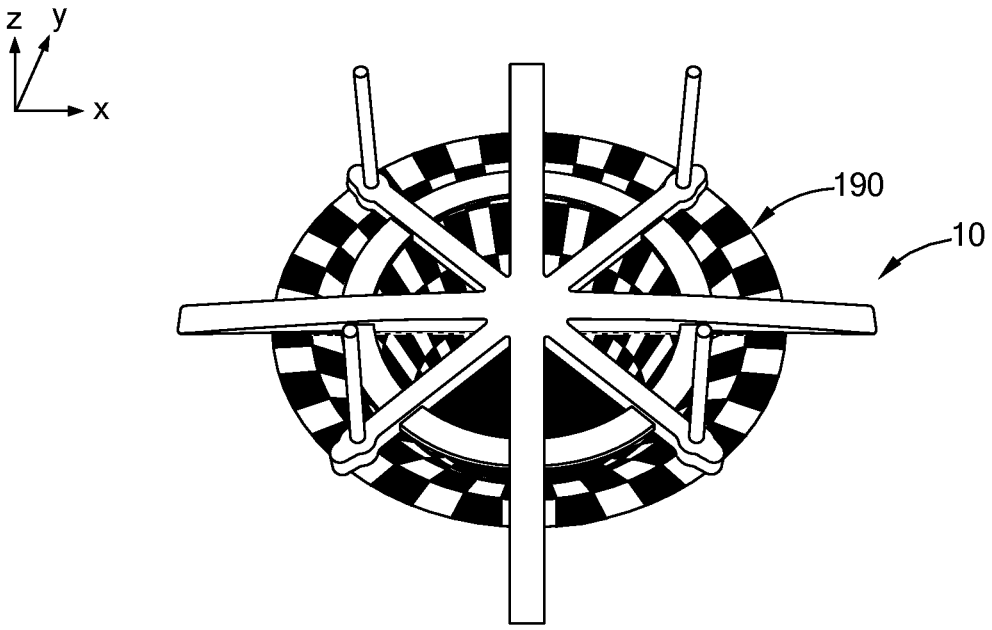
FIG. 10B is a perspective view of a golf putting training device according to the teachings of the present disclosure positioned over the grid pattern in FIG. 10A.

Referring now to FIGS. 10A and 10B, in one form of the present disclosure, the putting device may include a kit comprising a grid pattern that has the visual appearance of a golf hole. Particularly, FIG. 10A schematically depicts a grid pattern 190 that may be positioned on a putting surface. As shown in FIG. 10A, the grid pattern provides the appearance of a hole, e.g., a golf hole. Accordingly, the putting device 10 may be positioned on the grid 190 as schematically depicted in FIG. 10B and thereby provide a visual appearance of putting towards a golf hole.

Figure 11:
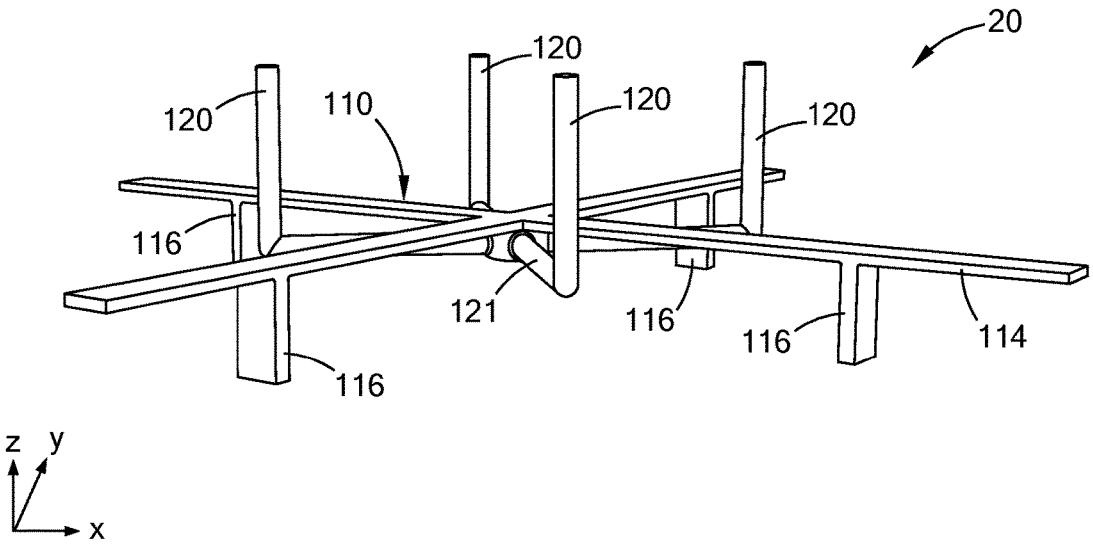
FIG. 11 is a perspective view of a golf putting training device according to the teachings of the present disclosure.

Referring now to FIG. 11, in another form of the present disclosure, a putting device 20 may include a base 100 with a post cross-brace 121 extending below (−z direction) the pair of alignment guides 104. A pair of posts 120 extend upwardly from the post cross-brace 121. In some aspects of the present disclosure, a pair of posts 120 and a post cross-brace 121 may be a single member extending below (−z direction) the base 100. Also, the bottom tabs 116 may extending downwardly (−z direction) from the alignment guides 104 as schematically depicted in FIG. 11.

Figure 12A:
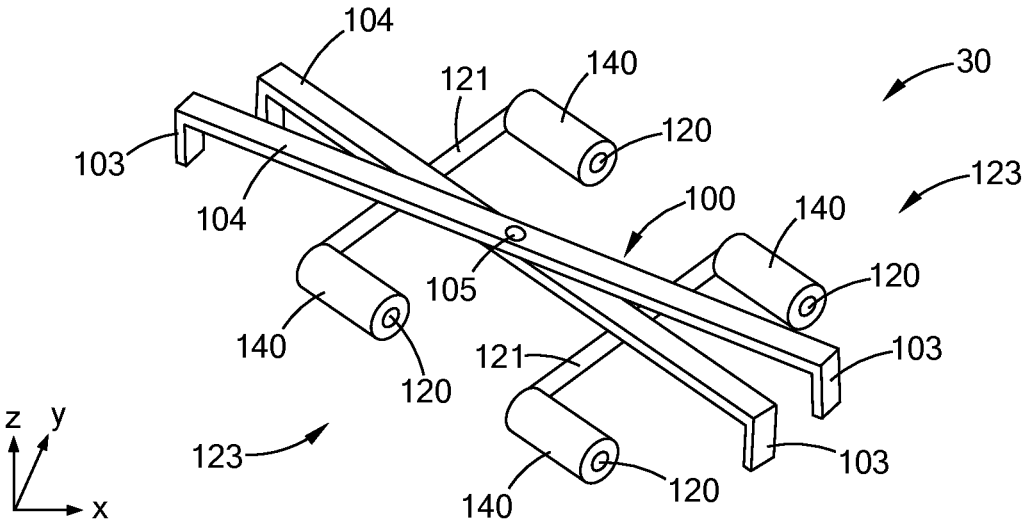
FIG. 12A is a perspective view of a golf putting training device before assembly according to the teachings of the present disclosure.
Figure 12B:
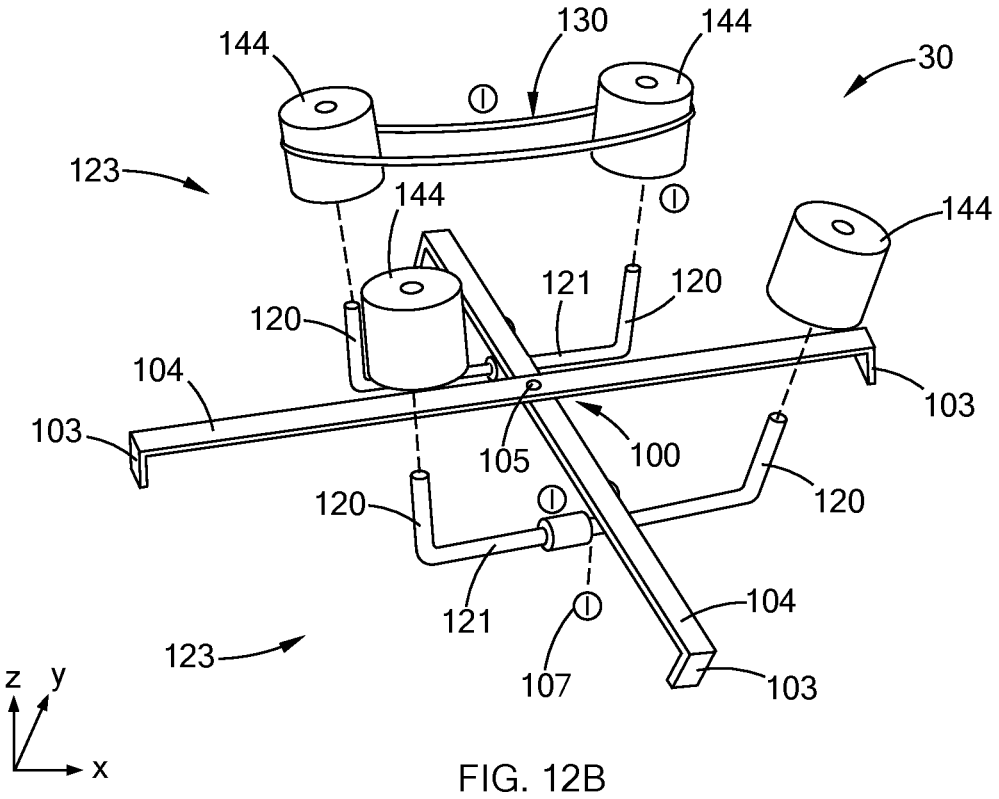
FIG. 12B is an exploded view of the golf putting training device in FIG. 12A.
Figure 12C:
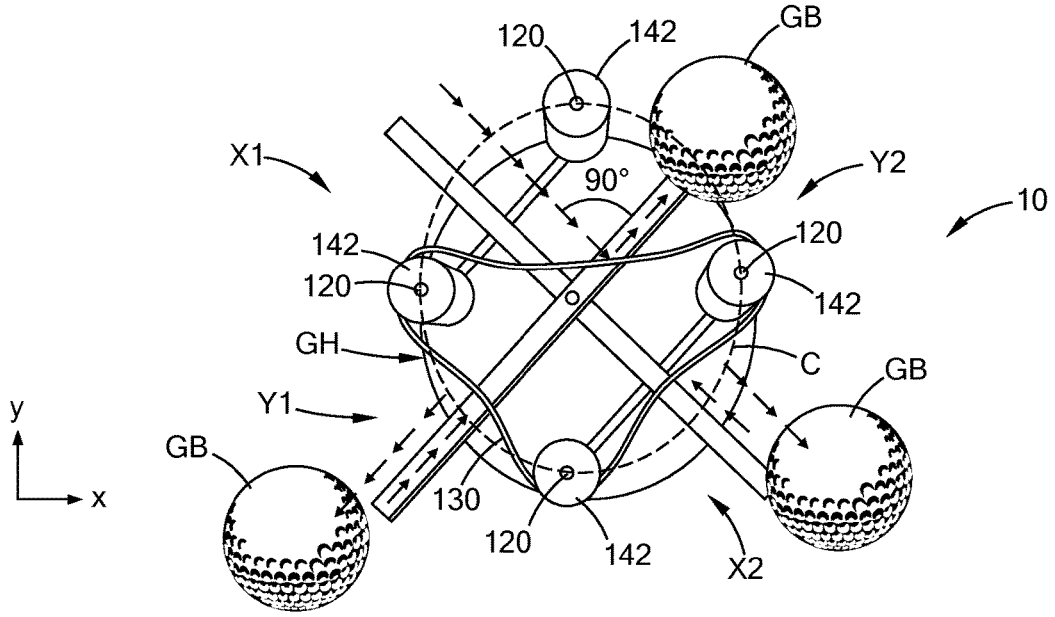
FIG. 12C is a top view of the golf putting training device in FIG. 12A after being assembled, positioned on a putting service and being used with an elastic member to redirect golf balls putted towards the golf putting training device.

Referring now to FIGS. 12A-12C, in another form of the present disclosure, a putting device may comprise a disassembled configuration and an assembled configuration. Particularly, a putting device 30 may include a pair of alignment guides 104 pivotally connected to each other about a pivot axis 105. The pivotal connection between the pair of alignment guides 104 allows for the alignment guides to be folded together for storage and/or travel. The putting device 30 also includes a pair of post assemblies 123 that each comprise a pair of posts 120 extending from a post cross-brace 121. Referring particularly to FIG. 12A the putting device 30 is schematically depicted in a disassembled configuration. In some aspects of the present disclosure, the pair of alignment guides 104 are pivoted about the pivot axis 105 such that the alignment guides extend generally parallel with each other (e.g., within +/−10 degrees) and the pair of post assemblies 123 lie within a plane generally parallel to the pair of alignment guides 104 (i.e., x-y plane shown in FIG. 12A). A pair of securement tabs 117 extend downwardly (−z direction) from opposite ends of each of the alignment guides 104. It should be understood that the putting device 30 in the disassembled configuration allows for the putting device to be placed and/or stored in a container (not shown) such as a bag, a box, and the like. It should also be understood that the putting device 30 in the disassembled configuration provides a convenient package for storing the putting device, e.g., in a golf bag, suitcase, briefcase, etc., such that the putting device 30 can be conveniently stored by a golfer when traveling to a golf course, on a business trip, on a golf vacation, and the like.

Referring now to FIG. 12B, an exploded view of the putting device 30 in an assembled configuration is schematically shown. Particularly, the pair of alignment guides 104 have been rotated about the pivot axis 105 such that the pair of alignment guides are oriented generally 90 degrees relative to each other. Also, the pair of post assemblies 123 are positioned such that the posts 120 extend normal (+z direction) relative to the plane of the alignment guides (x-y plane) and fastener 107 (e.g., a screw) may be used to attach the pair of post assemblies 123 to one of the alignment guides 104 (FIG. 12C). While FIG. 12A schematically depicts post sleeves 140 positioned on the posts 120, FIG. 12B schematically depicts posts sleeves 144 positioned on the posts 120 and an elastic member 130 (e.g., a rubber band) extending between and around a pair of sleeves 144.

Referring now to FIG. 12C, the putting device 30 fully assemble and positioned over a golf hole 'GH' is schematically depicted. Also, the elastic member 130 is extending between and around three posts 120 thereby providing a golf ball return mechanism for one or more golf balls GB being putted towards the narrow openings X1, X2, Y1, and/or Y2.

In use, a golfer may travel to a golf course with the putting device 10, 20, and/or 30 and position the putting device onto a putting surface with the bottom tabs 116 (putting devices 10 and/or 20) or securement tabs 117 (putting device 30)

extending into a golf hole GH or into the putting surface, respectively, such that the putting device 10, 20, and/or 30 is removably attached to the putting surface. In the alternative, a golfer may use the putting device 10 at home, at the office, etc., where there is a flat surface. A golfer may then place a golf ball GB a desired distance from one of the narrow openings X1, X2, Y1, or Y2 of the putting device 10, 20 and/or 30, align himself/herself and the putter in order to attempt to put the golf ball GB through the narrow opening X1, X2, Y1, or Y2. It should be understood that when the golfer has aligned himself/herself with his/her eyes directly over the golf ball GB, and then turns his/her head to view the narrow opening X1, X2, Y1, or Y2, if the golfer is correctly aligned with respect to the narrow opening X1, X2, Y1, or Y2, the posts will be aligned as schematically depicted in FIG. 13. Accordingly, the putting device 10, 20, and/or 30 also provides an alignment device to assist a golfer in obtaining proper alignment during putting. After the golfer has set-up and aligned himself/herself to putt the golf ball GB, he/she putts the ball towards the narrow opening X1, X2, Y1, or Y2. The golfer can then repeat this process either using the elastic member 130 and/or the post sleeves 140, 142 and/or 144 in order to improve his/her technique, focus, confidence, etc., during putting.

The terms "generally" and "about" refer to variations in measurements and distances disclosed herein due to error in taking such measurements and measuring such distances using known measuring devices. The terms "upper," "lower," "upwardly," "downwardly," and the like, refer to directions schematically depicted in the figures and do not and should not be interpreted to represent absolute orientations and/or directions of a product and/or method taught in the present disclosure and recited in the claims unless otherwise noted.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A golf putting training device comprising:
a base; and
a plurality of posts extending upwardly from the base, the plurality of posts positioned on a diameter of a circle;
an alignment guide extending between at least two of the plurality of posts through a center of the circle, wherein:
a distance between at least two of the plurality of posts is less than a golf hole diameter and provides a narrow opening for a golf ball to roll through.

2. The golf putting training device of claim 1, wherein the diameter of the circle is between about 3.0 inches and about 5.0 inches.

3. The golf putting training device of claim 1, wherein the circle diameter is about 4.0 inches.

4. The golf putting training device of claim 1, wherein a distance between two of the plurality of posts is between about 3.75 inches and about 1.75 inches.

5. The golf putting training device of claim 1 further comprising another alignment guide extending through the center of the circle and oriented 90 degrees relative to the alignment guide.

6. The golf putting training device of claim 1 further comprising a plurality of securement posts extending downwardly from the base, wherein the plurality of securement posts are positioned on a diameter such that the plurality of securement posts fit within a golf hole diameter.

7. The golf putting training device of claim 1, wherein the base has a generally flat bottom surface.

8. The golf putting training device of claim 7 further comprising an attachment surface on the bottom surface, wherein the attachment surface comprises at least one of a hook and loop fastener, an adhesive, and a tacky surface.

9. The golf training device of claim 1, wherein the plurality of posts is four posts and the four posts are positioned equidistant from each other on the diameter of the circle.

10. The golf training device of claim 1 further comprising an elastic member attached to two of the posts and extending across the narrow opening between the two posts.

11. The golf training device of claim 10, wherein the elastic member is configured to redirect a golf ball rolling towards the narrow opening and rolling into the elastic member.

12. The golf training device of claim 1 further comprising a pair of sleeves positioned on a pair of adjacent posts, wherein the pair of sleeves reduce the narrow opening for the golf ball to roll through.

13. A golf training device comprising:
a base with a center; and
a pair of posts positioned on and extending upwardly from a diameter on the base;
an alignment guide extending between the pair of posts and aligned with the center of the base, wherein the pair of posts have a narrow opening therebetween for a golf ball to roll through and the narrow opening between the pair of posts is less than a golf cup hole diameter.

14. The golf training device of claim 13 further comprising another pair of posts such that four posts are positioned on the diameter of the base 90 degrees relative to each other.

15. The golf putting training device of claim 13 further comprising another alignment guide extending through the center of the ring 90 degrees relative to the alignment guide.

16. The golf putting training device of claim 13, wherein a distance between the pair of posts is between about 3.75 inches and about 1.75 inches.

17. The golf training device of claim 13 further comprising a pair of sleeves positioned on the pair of posts, wherein the pair of sleeves reduce the narrow opening between the pair of posts.

18. A method of practicing putting a golf ball comprising:
positioning a golf putting training device on a putting surface, the golf putting training device comprising:
a base;
a plurality of posts positioned on and extending upwardly from a diameter of a circle; and
an alignment guide extending between at least two of the plurality of posts through a center of the circle, wherein the plurality of posts have a narrow opening therebetween for a golf ball to roll through and the narrow opening between the plurality of posts is less than a golf hole diameter and provides a narrow target for putting practice;
positioning a golf ball on the putting surface at a distance from the narrow opening; and
putting the golf ball towards the narrow opening.

19. The method of claim 18 further comprising:
extending an elastic member between at least two of the plurality of posts across the narrow opening; and putting the golf ball towards the narrow opening, wherein the elastic member redirects the golf ball when the golf ball rolls into the elastic member.

20. The method of claim 18 further comprising positioning at least one sleeve onto at least one of the plurality of posts, wherein the at least one sleeve positioned on the at least one of the plurality of posts reduces the narrow opening between the at least two posts.

* * * * *